United States Patent [19]

Dryczynski et al.

[11] 4,353,970

[45] Oct. 12, 1982

[54] METHOD AND APPARATUS FOR ELECTROSTATICALLY CHARGING A DIELECTRIC LAYER

[75] Inventors: Kurt Dryczynski, Hofheim; Günther Schädlich; Roland Moraw, both of Wiesbaden, all of Fed. Rep. of Germany

[73] Assignee: Hoechst Aktiengesellschaft, Frankfurt am Main, Fed. Rep. of Germany

[21] Appl. No.: 92,276

[22] Filed: Nov. 8, 1979

[30] Foreign Application Priority Data

Nov. 13, 1978 [DE] Fed. Rep. of Germany ..... 2849222

[51] Int. Cl.[3] ..... G03G 13/02; G03G 13/22

[52] U.S. Cl. ..... 430/31; 430/296; 430/902; 346/153.1; 346/159; 250/325; 250/326; 355/36 H; 361/225; 361/229; 361/230; 427/14.1

[58] Field of Search ..... 430/31, 902, 125, 296; 250/325, 326; 361/225, 229, 230; 355/3 CH

[56] References Cited

U.S. PATENT DOCUMENTS

| | | | |
|---|---|---|---|
| 3,413,146 | 11/1968 | Anderson et al. | 430/296 |
| 3,543,022 | 11/1970 | Lennon | 430/902 X |
| 3,594,162 | 7/1971 | Simm et al. | 430/902 X |
| 3,708,661 | 1/1973 | Hansen et al. | 250/325 X |
| 4,086,650 | 4/1978 | Davis et al. | 361/229 |
| 4,096,543 | 6/1978 | Kozuka et al. | 361/230 |
| 4,168,973 | 9/1979 | Simm et al. | 361/225 X |

FOREIGN PATENT DOCUMENTS

| | | |
|---|---|---|
| 1572381 | 2/1970 | Fed. Rep. of Germany . |
| 2352656 | 5/1975 | Fed. Rep. of Germany . |
| 2511633 | 9/1976 | Fed. Rep. of Germany . |
| 2611503 | 11/1976 | Fed. Rep. of Germany . |
| 1041698 | 4/1951 | France . |
| 1374923 | 11/1974 | United Kingdom . |
| 1480321 | 7/1977 | United Kingdom . |

OTHER PUBLICATIONS

Kankeinen, "Corona Charger", Res. Discl., Feb. 1974, pp. 28–29.

Cecil, "Removal of Electrostatic Images by Coronas", IBM Tech. Discl. Bull., vol. 12, No. 12, May 1970, p. 2116.

*Primary Examiner*—Roland E. Martin, Jr.

*Attorney, Agent, or Firm*—Schwartz, Jeffery, Schwaab, Mack, Blumenthal & Koch

[57] ABSTRACT

A method and an apparatus for charging a dielectric layer electrostatically to a predetermined potential. An AC electrode is arranged at a distance from the dielectric layer and connected to one output of an AC voltage generator. The AC voltage generator has the other output connected to an output of a DC voltage generator. Between the AC electrode and the dielectric layer there is a DC electrode which is connected to the other output of the AC voltage generator. The dielectric layer rests on a counter-electrode which is connected to the other output of the DC voltage generator and is at ground potential. Each of the electrodes can comprise one or a plurality of mutually insulated single electrodes.

17 Claims, 12 Drawing Figures

2
32
10
19
$2_1$ U~
0~
$2_0$
17
18
13
6
14
11
4
$1_1$
U=
1
7
5
8
0=
9
$1_0$
3
16
33
12
15

19
2
$2_1$ U~
0~
$2_0$
17
18
6
4
$1_1$
23
1
U=
7
5
0=
9
$1_0$
3
26
16
33

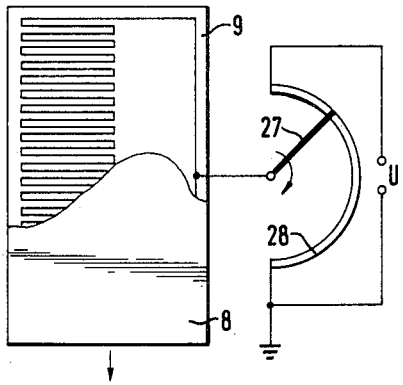
Fig. 9
Fig. 10
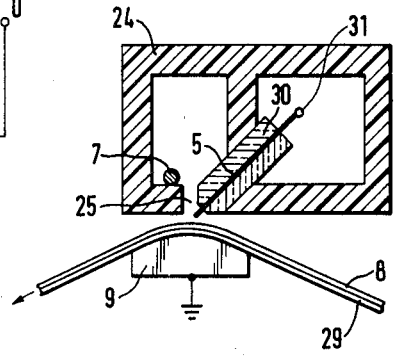
Fig. 11
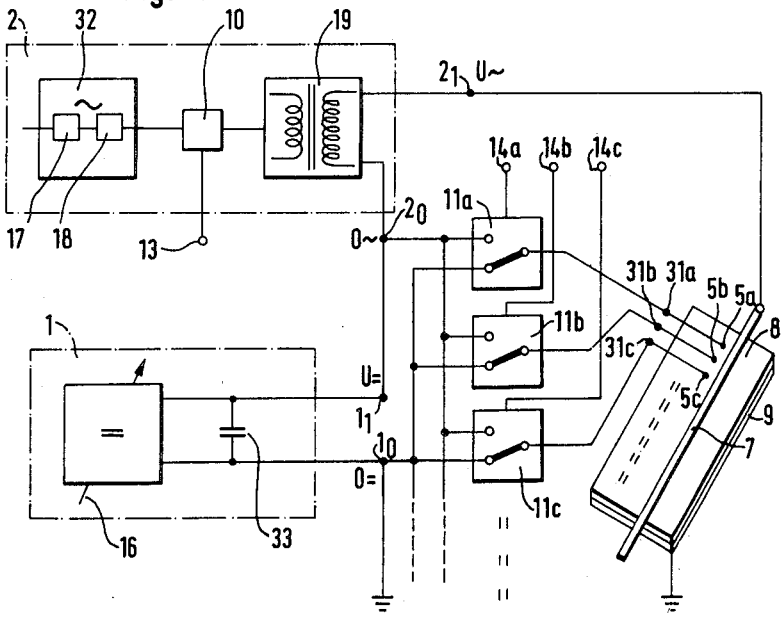

METHOD AND APPARATUS FOR ELECTROSTATICALLY CHARGING A DIELECTRIC LAYER

BACKGROUND OF THE INVENTION

1. Field of the Invention

The invention relates to a method and apparatus for electrostatically charging a dielectric layer to a predetermined potential with the aid of an alternating electric field and a constant electrostatic field.

2. Description of the Prior Art

A prior art electro-photographic development process disclosed in reference "Tappi/February 1967, Vol. 50, No. 2, pages 77A–79A" teaches providing an electro-photographic layer with an electrostatic surface charge by means of an electrode to which both a high-frequency high voltage and a direct current voltage are applied simultaneously. The electrode, for example a very thin corona wire or fine metallic points, is arranged close to an insulated metallic surface and due to the alternating voltage in the air generates ions of both polarities. Those with the appropriate polarity are accelerated by the direct voltage towards the electro-photographic layer.

With a negative voltage at the electrode, strong inhomogeneities of the ions will occur close to the surface of the wire, causing fluctuations in the charge which will adversely affect the image generation on the electro-photographic layer such that, for example, a solid area in an original copy will be reproduced unevenly. By overlaying the direct current voltage field with the alternating current voltage field, the discharge voltage of the electrode is affected. Because of the pre-existing direct voltage has the amplitudes of the alternating voltage superimposed on it, voltage peaks are produced which lead to a breakdown of the layer to be charged up.

From German Offenlegungsschrift No. 2,231,530 a method is disclosed for the electro-photographic recording of images on an insulating recording base which is pulled over a support electrode while above the contact point with the support electrode. The charge image is recorded by tracing electrodes on the other side of the recording base. To accomplish this, an electrode arrangement is used in which a portion of the current of the corona discharge of a discharge electrode reaches the recording base through the opening of a slit aperture formed by the electrodes, and there produces a charge above the line of contact between the recording base with the support edge. The partial discharge current is controlled by electric image signals via the aperture formed by four flat electrodes. For this at least one of the electrodes is subdivided into a number of conductor strips via which the signal voltage is supplied.

German Offenlegungsschrift No. 2,423,245 describes a method for the electro-photographic recording of images on an insulating recording base by means of a corona discharge from which a part of the discharge current is removed via a slit aperture and used for charging the recording base. Here, too, the image-dependent charging is done by control voltages at a tracing electrode which is located on the side of the recording base facing away from the slit and which is in contact with the recording base. The electric contact between the tracing electrode and the insulating recording base is facilitated by supplying a conductive contact fluid to the contact point. In this arrangement, the charging of the recording base can take place in streaming nitrogen.

It is the object of the invention to produce a method for the gentle and safe electrostatic charging of insulating dielectric layers, while avoiding breakdowns, wherein the magnitude of the charging current and the charge distribution can be reproduced in a changeable and highly accurate manner with pronounced linearity between the charging current and the pre-existing direct current voltage.

SUMMARY OF THE INVENTION

The above and other objects are achieved by the method of generating charge carriers at a distance from the dielectric layer by means of an AC electric field. The generated charge carriers are directed to charge the dielectric by the DC electric field, neither field being sufficiently strong to cause dielectric breakdown.

The inventive method is implemented by providing an AC voltage generator connected to an AC electrode which is located a distance away from the dielectric layer. A DC electrode is connected to a DC voltage generator which is also connected to the AC voltage generator and the DC electrode is located in the path between the AC electrode and the dielectric layer. Ion charge carriers are produced by the AC generator acting upon the AC electrodes which are directed to the dielectric layer by the DC electric field, thereby charging the dielectric layer.

BRIEF DESCRIPTION OF THE DRAWINGS

In the text which follows, illustrative embodiments of the invention are described in greater detail in the drawings, in which:

FIG. 9 is a partial cutaway view of one embodiment of the counter-electrode;

FIG. 10 is an end cross-sectional view of another electrode arrangement with shielding, modified with respect to FIG. 6;

FIG. 11 is an electrical schematic of a circuit arrangement of a further embodiment.

DETAILED DESCRIPTION OF A PREFERRED EMBODIMENT

In order to provide gentle and safe electrostatic charging of the insulating dielectric layer while at the same time preventing breakdown in this layer, charge carriers are generated at a distance from the dielectric layer by an alternating electric field. The charge carriers are then directed as a charging current to the surface of the dielectric layer under the influence of the DC electrostatic field permeating the layer to be charged. In various embodiments of the invention, the dielectric layer may consist of a photoconductive and/or thermoplastic recording base, during the charging of which at least one of the AC and DC voltage fields is modulated.

Figure 1:
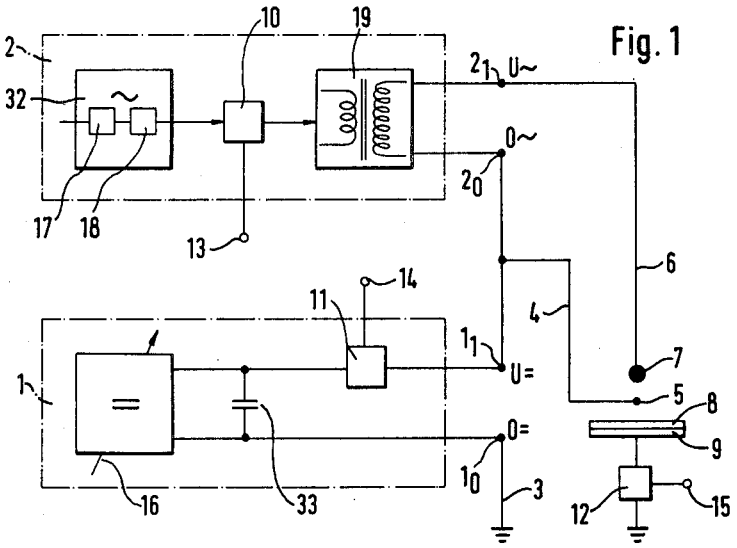
FIG. 1 is an electrical schematic of the circuit arrangement of an embodiment of the device according to the invention.

The device according to FIG. 1 comprises a DC voltage generating means, for example generator 1, and an AC voltage generating means, for example generator 2. The DC voltage generator 1 contains a voltage regulator 16 which produces a DC voltage which can be varied between zero and a maximum value of several kV. A smoothing capacitor 33 is connected in parallel with the output of the DC voltage regulator 16 or the DC voltage generator 1. In series with the hot output $1_1$ of the DC voltage generator 1 is a switching element 11 with an input terminal 14 which can be used to modulate the direct voltage. The output terminal $1_0$ is at earth potential via a line 3. The DC voltage $U_{DC}$ of the DC voltage generator 1 can be adjusted between 0 and 20 kV and is applied from the hot output terminal $1_1$ via a line 4 to a DC electrode means, for example electrode 5, which is arranged at a distance from the dielectric layer 8 to be charged. This dielectric layer 8 is, for example, a photoconductive and/or thermoplastic recording medium which is charged to a required voltage, exposed to an image or to data, and is developed with toner. Relief pictures can also be formed during the photoconductive process by simultaneously charging the thermoplastic recording layer, exposing it to the image and thereafter heating to form the relief pictures.

The AC voltage generator 2 includes an AC voltage source means, for example source 32, which comprises voltage regulator means, for example regulator 17, and a frequency control means, for example control 18. The AC voltage of the AC voltage generator 2 is 1 to 10 $kV_{RMS}$ at a frequency between 1 and 100 kHz. The voltage regulator 17 is used for adjusting the amplitude of the AC voltage while the frequency control 18 is used to tune the frequency of the AC voltage. The AC voltage generator 2 also comprises an isolating transformer 19 which steps up the AC voltage supplied by the AC voltage source 32 and ensures an ungrounded cascade connection of the AC voltage to the hot terminal $1_1$ of the DC voltage generator 1. For this, the cold output terminal $2_0$ of the AC voltage generator 2 is connected to the hot output terminal $1_1$ of the DC voltage generator 1. Into the connecting line between the AC voltage source 32 and the isolating transformer 19, a switching element 10 is connected, which can be used to feed in a voltage for modulating the AC voltage by means of terminal 13. The hot output terminal $2_1$ of the AC voltage generator 2 is connected via a line 6 to an electrode 7 which is farther removed from the dielectric layer 8 to be charged than the DC voltage electrode 5. The AC voltage $U_{AC}$ of the AC voltage generator 2 is supplied to the AC voltage electrode 7 via the line 6. The layer 8 to be charged up to the voltage $U_{DC}$ is located on a counter-electrode means, for example electrode 9. Into the ground line of this electrode 9 which is the counter-electrode to the DC voltage electrode 5, a switching element 12 is connected for interruption of the ground connection and changing the potential of the electrode 9 by means of terminal 15. Via this terminal a voltage may be supplied to the switching element 12.

The electrode 5 is also used as counter-electrode for the AC voltage electrode 7 since the output terminal $2_0$ of the AC voltage generator 2 is connected to the output terminal $1_1$ of the DC voltage generator 1 and is connected via the line 4 to the DC voltage electrode 5.

The special design of the device makes a completely new and special charging technique possible. Between the DC voltage electrode 5, which is a corona charging electrode, and the AC voltage electrode 7, the AC voltage $U_{AC}$ is applied. The electrode 5 may comprise, for example, a thin corona wire of a thickness of 50 to 300 $\mu$m, although other charging corona electrodes of suitable construction can also be used. For AC voltage electrode 7, an electrode of any shape is used, the cross-section and surface of which are of such a shape that no ions are generated in their immediate environment. Thus, for example, the AC voltage electrode 7 can be a round electrode with a diameter of 2 mm. With the aid of the AC voltage electrode 7, the atmosphere immediately surrounding the electrode 5 is ionized and the amplitude of the AC voltage $U_{AC}$ is selected to be high enough so that an adequate number of the required ions is available in the region of the electrode 5 even with a maximum requirement for charging current. With strong ionization, a visible glow will occur on the periphery of the electrode 5.

If the DC voltage $U_{DC}$ is applied to the electrode 5, either a positive or a negative charging current is conducted to the layer 8 according to the polarity of the DC voltage $U_{DC}$. As can be seen from curve a in FIG. 2, a nearly linear relationship exists here over a wide operating area between the charging current I ($\mu$A) and the DC voltage $U_{DC}$ (kV) applied to the electrode 5. This pronounced linearity between the charging current and the pre-existing DC voltage makes a reproducible charging of the layer 8 to the respective predetermined DC voltage possible. Because the charging current I begins in the lower current region with DC voltages of a few volts, possibly at a voltage of less than 1 volt, it is desirable that the alternating voltage have an extremely symmetrical relationship to ground. If the AC voltage were biased with a slight DC voltage, this distortion in the AC field would produce changes in the predetermined charging magnitude. In order to achieve an extremely accurate charging magnitude, a stable and well-matched mechanical construction of the charging device is also necessary. Interfering foreign fields must be shielded or compensated for, if necessary, by switching in a suitable compensating potential.

Figure 2:
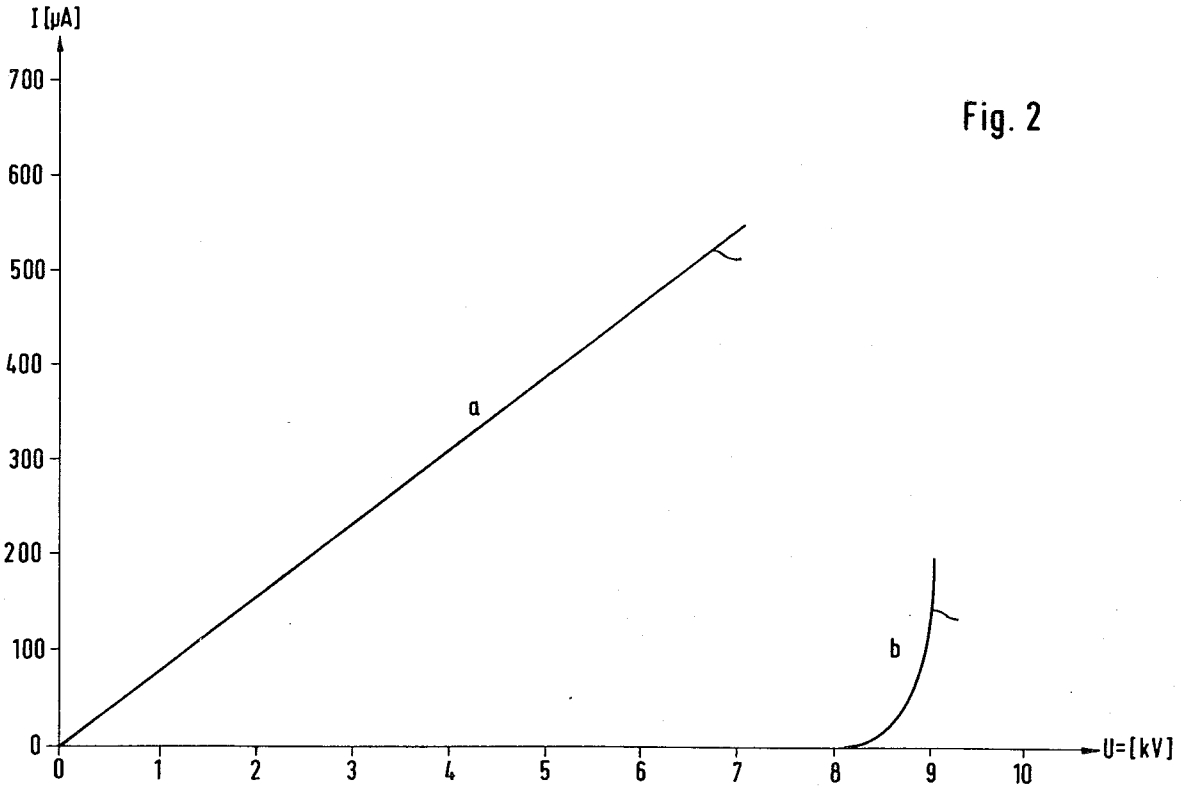
FIG. 2 is a graph showing the curve for the charging current as a function of the direct voltage applied to an electrode with and without the alternating electric field.

The curve b in FIG. 2 shows the charging current as a function of the DC voltage of a prior art charging corona of the same magnitude, operating without an AC electric field. Curve b shows that the charging begins only with a DC voltage greater than 8 kV and very rapidly asymptotically approaches the breakdown voltage for the layer to be charged, which is, for example, about 9 kV. The charging current I, according to curve b for a voltage just below the breakdown voltage, can be achieved, according to curve a, with a considerably smaller DC voltage which is less by an amount approximately equal to the corona start voltage. As can be seen from curve a in FIG. 2, this reduced DC voltage is approximately 2.2 kV. This reduction in DC voltage, by the amount of the corona start voltage, considerably reduces the number of breakdowns in the layer 8 due to the ions, separate from the corona discharge, produced with the aid of the high-frequency alternating electric field. If as in the present invention the DC voltage electrode 5 is operated as corona electrode with the same voltage as customary corona devices, a charging current can be achieved which is much greater than in the known corona devices.

Figure 3:
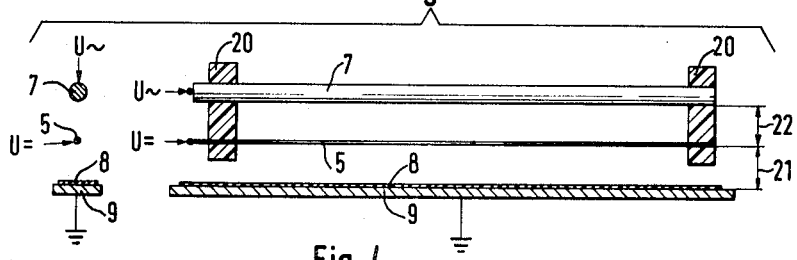
FIGS. 3–5 are cross-sectional front and side views of various electrode arrangements of the device.
Figure 4:
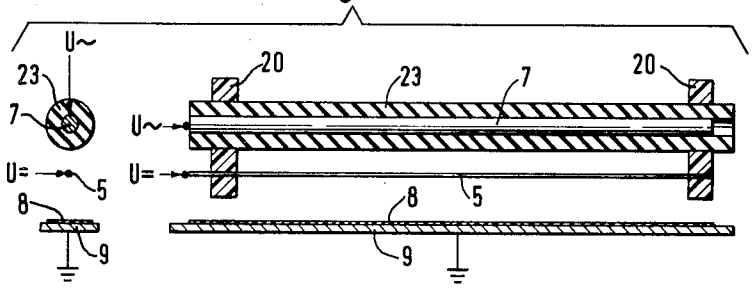
Figure 5:
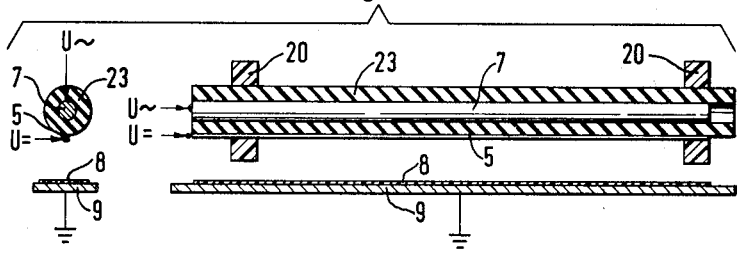

The electrodes 5 and 7 can be suitably combined in electrode arrangements, some of which are represented diagrammatically in the FIGS. 3–5.

The electrode arrangement in FIG. 3 comprises a thick wire as AC voltage electrode 7 and a thin wire as DC voltage electrode 5 which are clamped by two insulators 20 and are fixed in their mutual position and with respect to the layer 8 to be charged and the counter-electrode 9. For the electrode 7, a copper or other metal wire may be used which has a diameter of 1 to several millimeters. Instead of a wire, other metal profiles can be used. For the electrode 5, preferably a tungsten or steel wire from about 10 to several 100 μm thickness is selected.

A distance 21 between the electrode 5 and the layer 8 to be charged and a distance 22 between the two electrodes 5 and 7 are from 1 to about 20 mm. In the electrode arrangement shown in FIG. 4, the AC voltage electrode 7 is enclosed by an insulating body 23. For this, for example, the electrode 7 can be fused or inserted into a glass tube. This provides a better insulation between the electrode 7 and the DC voltage electrode 5 and, for an AC voltage of the same magnitude as in the electrode arrangement according to FIG. 3, a higher field strength is obtained in the air space between the electrode 5 and the insulating body 23. This is the result of the high dielectric constant of approximately "5" for glass in comparison to air, since, as is known, the single field strengths are inversely proportional to the dielectric constants of different materials.

The freely clamped electrode 5 comprised of thin wire is susceptible to mechanical vibrations, particularly if the lengths of the span are large. This tendency towards vibration can be partially suppressed by high tension in the clamping forces on the electrode 5. The problem vibration of the electrode 5 can be solved more favorably with an electrode arrangement shown in FIG. 5, where the electrode 5 is held in direct contact with the surface of the insulating body 23. For this, the electrode 5 can be clamped onto the surface of the insulating body 23 in a simple manner or fused into its surface. The electrode 5 can also be applied to the insulating body 23 by galvanic methods or by baking in. Such an electrode arrangement with an electrode 5 fixed on the insulating body 23 is particularly suitable for elongated coronas up to a length of 1 m and more, which may be used, for example, in electro-photographic copying devices for producing copies of originals such as technical drawings which have large areas.

As mentioned before, the previously described electrode arrangements also make possible very low-value charges of the layer 8 with a voltage of 1 volt and less so that it is possible to neutralize undesirable surface or residual charges on electro-photographic recording materials to a large extent. For example, X-ray intensity patterns radiated into ionization chambers are transferred into corresponding charge patterns on insulating layers which, after being developed with toner, produce visible pictures of the X-ray intensity distribution. In this process it may be necessary, prior to X-ray irradiation, to neutralize surface charges on the insulating layers, arising, for example, by triboelectric contact with other layers, so that they do not overlay the charge patterns in an undesirable manner. Neutralization takes place, for example, in such a manner that the DC voltage electrode 5 is connected to ground and the AC voltage electrode 7 is supplied with an AC voltage of such a magnitude that the residual charge becomes small to the point of disappearance as the layer 8 is moved past below the electrode 5. For this it may be necessary to specially adjust the electrodes and balance the alternating voltage and to shield or compensate for foreign electrostatic fields.

As has been mentioned before, in the device according to FIG. 1, it is possible to modulate charging which is a highly desired feature. It is generally known that, in the development of charge images with large solid areas, a preferred toner precipitation takes place at the edges of the image, producing so-called edge images if no special measures are taken such as providing additional developing electrodes. Another possibility for achieving a solid-area toner precipitation and for improving the reproduction of half tones consists in rastering the charge image. Here, the area is generally first charged homogeneously and then exposed in a raster-shaped patter. It is also possible to apply the raster in one step, with good result, as a constant raster, for example with a sine-shaped charge distribution, or as fully modulated raster, for example, with a rectangular charge distribution, together with the charging. For this a raster of up to 20 lines/mm, preferably 5 to 10 lines/mm, is fully adequate for the demands made of qualitatively good office copies.

For the halftone rendering of relief pictures by Schlieren projection, too, the charge images forming the basis of the relief pictures must be rastered. Similarly, rasters up to 10 lines/mm are necessary for the application of the electrostatic relief picture technology in which the rapid development by deformation without adding additional developer for X-ray image recordings on insulating deformable layers in ionization chambers or on suitable photoconductive layers, for example selenium alloys, is used.

The electrode arrangement of the device is also very suitable, due to the pronounced linearity between charging current and DC voltage, for electrostatic copiers such as computer printers and telecopiers. In these applications the information, dissected line-by-line, is fed as a corresponding electric signal sequentially to the copier which applies a corresponding charge pattern line-by-line to the insulating layer on a dielectric recording base, generally with the aid of an electrode matrix of individual electrodes which can be driven individually. The charge pattern is made visible with toner or generates a relief picture on a layer deformed by heat. In this arrangement, the pronounced linearity between charging current and signal voltage, which in this case replaces the DC voltage, makes possible a local area charge on the recording support, which is proportional to the respective signal voltage. Depending on the area charge, toner is precipitated or the depth of the relief picture is modulated so that a good halftone-reproduction is guaranteed. Because of the great linear modulating range of the electrode arrangement, the halftones can be reproduced in small graduations.

For periodic, raster-shaped modulations, for generating rectangular charge distributions on the insulating layer, for example, the alternating voltage of the AC voltage generator 2 of the device according to FIG. 1 is modulated via the switching element 10. For this the switching element 10, for example an electromechanical relay which is opened and closed, is supplied with pulses via the terminal 13. Ions are generated between the electrodes 5 and 7 only in the closed condition of the switching element 10. The relays used can be operated, for example, at 200 Hz. Instead of electromechanical relays, electronic switches can also be used as switching element 10, permitting switching frequencies of 100 kHz and above.

With a switching frequency of 500 Hz for example, screened charge patterns with a raster of 5 lines/mm can be applied to a recording support moved at a speed of 10 cm/second.

Figure 6:
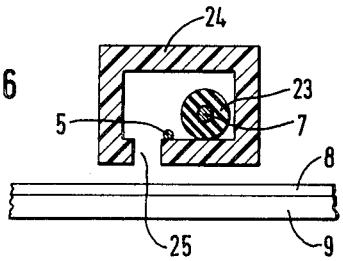
FIG. 6 is a cross-sectional side view of an electrode arrangement with shielding.

For the modulated charging preferably, shielded electrode arrangements, as shown in the FIGS. 6 and 10, are used.

In the arrangement according to FIG. 6, the DC voltage electrode 5 and the AC voltage electrode 7 with the insulating body 23 are located in an open shielding case 24 of electrically insulating material. The shielding case 24 is provided with a gap 25, at the edge of which the electrode 5 is located and under which the layer 8 is moved past. The gap width is approximately 1 mm and the distance of the electrode 5 to the layer 8 is between 5 and 15 mm. The ions generated in the interior of the shielding case 24 emerge through the gap and impinge on the layer 8. The shielding case 24 shields the light-sensitive layer 8 to a large extent against a corona glow of the electrode 5 and makes it possible to generate the ions and the charge within an atmosphere of protective gas, for example of nitrogen, which is introduced into the shielding case 24 and re-emerges through the gap 25. If the case is filled with pure nitrogen with a degree of purity of 99% or better, the charging current is increased while the adjustments of the electrodes remain unchanged. In addition, a small amount of positive pressure in the area of the corona protects the DC voltage electrode 5, working as corona electrode, from contamination.

Other possibilities for modulation exist via the switching element 11 in the DC voltage generator 1 and the switching element 12 in the ground line of the counter-electrode 9. These switching elements 11, 12 can be electro-mechanical relays or electronic switches and are controlled via the terminals 14 and 15, respectively. When the switching elements 11 and 12 are opened, the existing contacts are broken and signals variable in time and amplitude can be input. Modulation can take place also in such a manner that the switching elements 10, 11, 12 are controlled in such a manner that the existing contacts are not broken but the alternating or direct field is weakened during the modulation phase.

Modulation of the potential of the counter-electrode 9 by controlling the circuit element 12 via the terminal 15 produces uncomplicated circuit conditions. The switching element 12 is particularly suitable for being controlled by greatly varying signals. With composite signals, occurring with computer printouts or telecopiers, the electrode 9 may be split up across the width of the recording into a number of individually controllable electrode sections over which the insulating recording layer, for example a homogeneous dielectric paper or a foil, is passed. The information fed in via the switching element 12 can, if necessary, also be screened via the periodically excited switching element 10.

Figure 7:
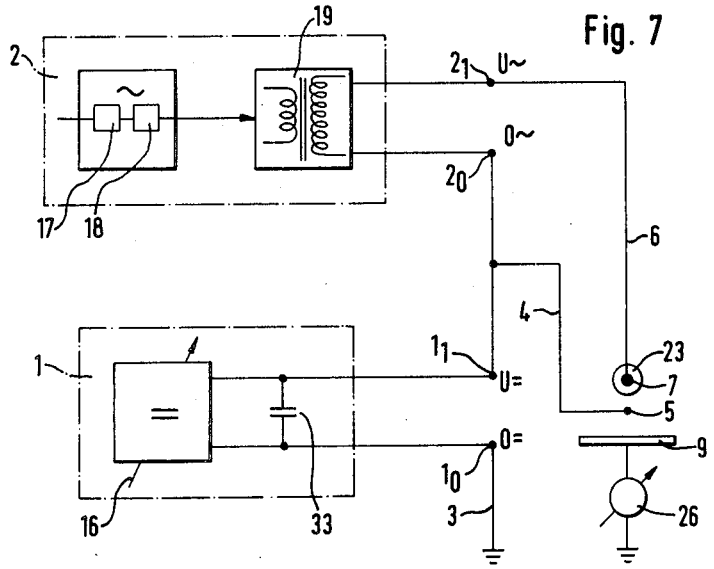
FIG. 7 is an electrical schematic of an embodiment of the device which is slightly modified with respect to FIG. 1.

The circuit configuration of the arrangement shown in FIG. 7 largely agrees with the device according to FIG. 1, with the differences that there are no switching elements and that the counter-electrode 9 of aluminum is connected to ground potential via a direct current meter 26. This arrangement was used to record the curves a–d and a'–d', shown in FIG. 8.

Figure 8:
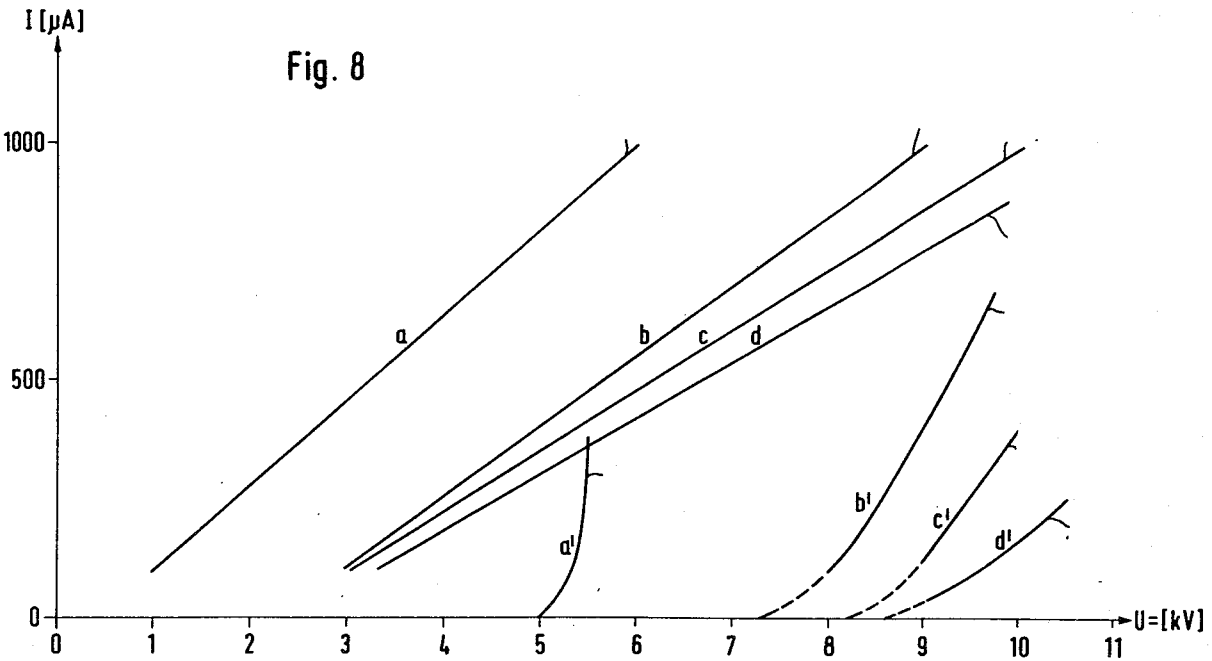
FIG. 8 is a graph showing the charging current as a function of the D.C. voltage on the direct voltage electrode with different spacings of this electrode from the counter-electrode, with and without the A.C. electric field.

FIG. 8 shows the linear relationship between the charging current I ($\mu$A) and the DC voltage $U_{DC}$ (kV) of the curves a, b, c, d for different distances between the direct voltage electrode 5 and the counter-electrode 9. For purposes of comparison, the corresponding curves a', b', c', d' are drawn in for the same different distances between the DC voltage electrode and the counter-electrode, with the electrode arrangement being operated with only DC voltage, that is to say without the A.C. electric field. The end points of the individual curves a–d and a'–d' indicate the charging current intensities shortly before the occurrence of voltage breakdowns in the layer to be charged. From the curves of FIG. 8, it can be seen that with approximately equal breakdown voltages for a charge of the layer with direct voltage, assisted by an alternating electric field, and with direct voltage alone, without alternating electric field, in the first case the achievable charging current intensities are lying considerably above those of the second case.

FIG. 9 shows a metallic counter-electrode 9, for example a copper layer into which on one side raster lines are etched photomechanically. This counter-electrode 9 is coated with an insulating recording layer 8. The raster lines of the counter-electrode 9 are connected to a center tap 27 of a potentiometer 28, the center tap being moved along the potentiometer 28, which is grounded on one side and has a voltage U applied to it, while the counter-electrode 9 is moving past under the DC voltage electrode. In this manner, a voltage drop of for example U=300 V to 0 V can be generated at the counter-electrode 9 during the recording, which produces a modulation of the recording by this change in the potential at the counter-electrode 9.

FIG. 10 shows another electrode arrangement surrounded by a shielding case 24. The DC voltage electrode 5 consists of a number of individual metal wires which are cemented in, spaced apart and insulated with respect to one another, between two glass plates 30 with hand-ground bevels. The points and the ends of the wires project at the front and rear end of the glass plates 30. The ends of the wires are provided with individual terminals 31 for applying the DC voltage. The surface of the counter-electrode 9 is slightly curved so that a dielectric paper consisting of an insulating cover layer 8 and a conductive paper base 29 changes its direction of movement in the region of the counter-electrode 9 in accordance with the curvature of the counter-electrode 9. According to the number of electrode wires 5*a*, 5*b*, 5*c*, etc., there are an equal number of terminals 31*a*, 31*b*, 31*c*, etc., at the ends of the wires of the DC voltage electrodes.

FIG. 11 shows diagrammatically the circuit configuration of the device with which the electrode arrangement according to FIG. 10 can be operated, by way of example. The DC voltage electrode 5 consists, as mentioned above, of individually controllable electrodes 5*a*, 5*b*, 5*c*, etc., which are voltage-controlled via a corresponding number of switching elements 11*a*, 11*b*, 11*c*, etc., with terminals 14*a*, 14*b*, 14*c*, etc. The switching elements 11*a*, 11*b*, 11*c*, etc., are connected to the terminals 31*a*, 31*b*, 31*c*, etc., of the individual electrodes 5*a*, 5*b*, 5*c*, etc. The rest of the circuit configuration corresponds to that according to FIG. 1.

Figure 12:
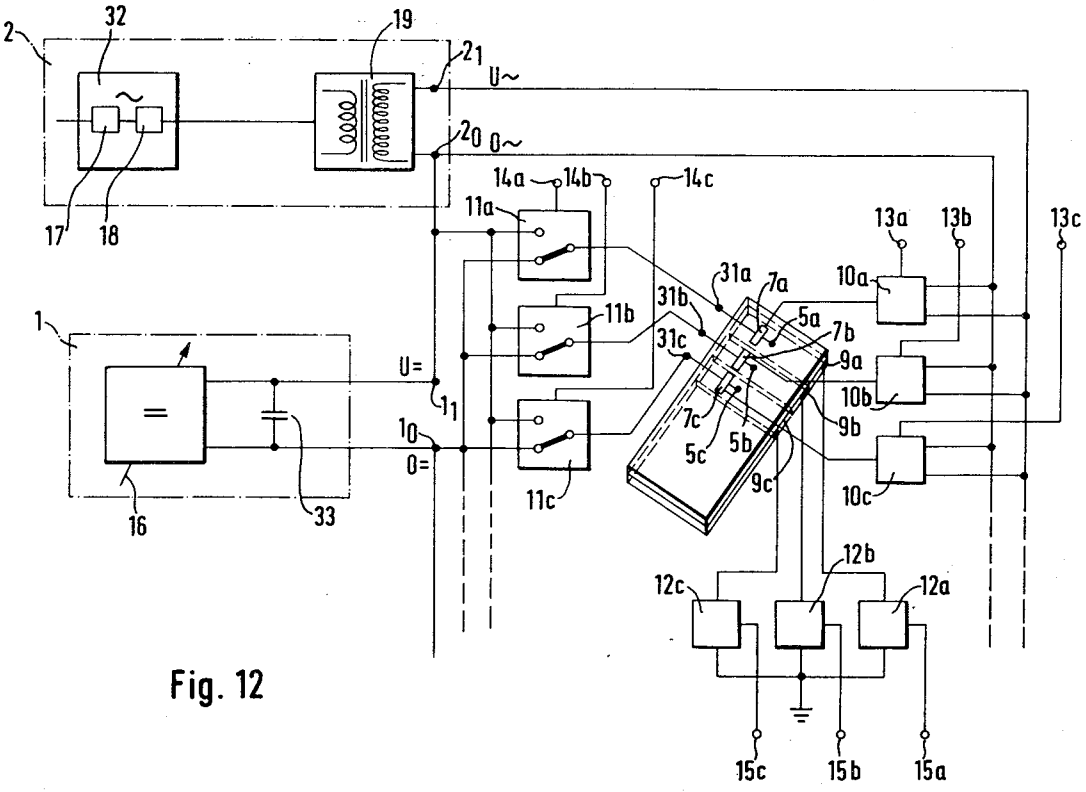
FIG. 12 is an electrical schematic of a modification of the circuit arrangement of FIG. 11.

In FIG. 12, a circuit arrangement of the device is shown in which each of the electrodes 5, 7 and 9 consists of several, mutually insulated individual electrodes 5*a*, 5*b*, etc.; 7*a*, 7*b*, etc.; and 9*a*, 9*b*, etc. The individual electrodes 5*a*, 5*b*, etc., of the DC voltage electrode 5 and the individual electrodes 7*a*, 7*b*, etc., of the alternating voltage electrode 7 are connected to the switching elements 11*a*, 11*b*, etc., and 10*a*, 10*b*, etc., to which voltages can be applied via corresponding terminals 14*a*, 14*b*, etc., and 13*a*, 13*b*, etc., respectively for the section-by-section modulation of the voltage of each individual electrode. The voltages applied to the individual electrodes for the purpose of modulation can be of different amplitudes. The remaining parts of the FIG. 12 correspond to those of FIGS. 11 and 1. These are the AC voltage generator 2 with the AC voltage source 32 comprising the voltage regulator 17 and the frequency control 18, and the isolating transformer 19.

The smoothing capacitor 33 is connected in parallel with the outputs of the DC voltage regulator 16 or the DC voltage generator 1, respectively.

The circuit elements 10, 11, 12, known from the device according to FIG. 1, are replaced by the aforementioned switching elements 10*a*, 10*b*, etc.; 11*a*, 11*b*, etc.; and 12*a*, 12*b*, etc., which are connected to the corresponding individual electrodes of the AC voltage electrode, DC voltage electrode and counter-electrode. The switching elements 10*a*, 10*b*, etc., and 12*a*, 12*b*, etc., are constructed analogously to the switching elements 11*a*, 11*b*, etc., that is to say they can switch back and forth between two positions according to whether a modulation voltage or a modulation signal is fed in or not.

In the following examples, operating data and parameters of the device are specified.

EXAMPLE 1

An electrode arrangement according to FIG. 4 was installed into a device according to FIG. 7. At a distance of 4 mm below the DC voltage electrode 5, the plate-shaped counter-electrode 9 of aluminum was placed and connected to ground potential via the direct current meter 26. Other data were:

AC voltage electrode 7 was comprised of a 1.8 mm thick copper wire;

DC voltage electrode 5 was comprised of a 50 μm thick tungsten wire;

Insulating body 23 was a 5 mm thick polytetrafluoroethylene tube;

Length of the DC voltage electrode 5 was 40 cm; and AC voltage applied was 5 $kV_{RMS}$/30 kHz.

The length of the DC voltage electrode 5 forming the corona electrode corresponds to the usual lengths of coronas in office copying machines. With +300 V DC applied, a current of 2 μA flows; with +700 V DC, 11 μA; and with +1200 V DC, 22 μA. Similar current values were obtained when applying a negative direct voltage to a direct voltage electrode 5. These charging currents were measured with DC voltages below the required operating voltage of the DC voltage electrode. If no alternating field was applied to the alternating voltage electrode 7, the charging current would be zero.

With exact adjustment of the AC voltage with respect to its symmetry and its freedom from distortion, with an alternating field applied to the AC voltage electrode 7, a charging current could be measured already with a direct voltage close to 0 V. When making the exact adjustment, it must be noted that, if the isolating transformer 19 of the AC voltage generator 2 is operated in the region of its natural resonance, even if with great damping, any retuning of the frequency will lead to phase shifts and effects on the sine-curve of the AC voltage.

EXAMPLE 2

The electrode arrangement according to FIG. 4 was installed in the device according to FIG. 7. The data were:

AC voltage electrode 7 again was a 1.8 mm thick copper wire;

DC voltage electrode 5 was a 100 μm thick steel wire;

Insulating body 23 was a glass tube with a diameter of 14 mm;

Length of DC voltage electrode 5 was 780 mm; and AC voltage was 5.5 $kV_{RMS}$/30 kHz.

The results of these measurements taken for distances between the DC voltage electrode 5 and the counter-electrode 9 of 5, 8, 10 and 13 mm are shown in FIG. 8 in the curves a, b, c and d.

EXAMPLE 3

The measurements of Example 2 were performed with a similar, but longer, DC voltage electrode. The length of the DC voltage electrode 5 was 1,290 mm and for the AC voltage electrode 7 a 4 mm thick VA-steel wire was used. The distances between the DC voltage electrode 5 and the counter-electrode 9 were the same as in Example 2. The charging currents were approximately 1.5 times those of Example 2.

EXAMPLE 4

An electrode arrangement according to FIG. 5 was installed in the device according to FIG. 7. As the DC voltage electrode 5, a strip of gold/palladium approximately 1 mm wide was applied to a ceramic insulating body 23 of 8 mm diameter and baked in. The other data were:

AC voltage electrode 7 was a 1.8 mm thick copper wire;

Length of DC voltage electrode 5 was 620 mm; and AC voltage was 3 $kV_{RMS}$/20 kHz.

The measured linear current increase in dependence on the DC voltage, which was varied between 1 and 7 kV, is shown in curve a in FIG. 2. As can be seen from the curve b in FIG. 2, a charging current occurs without the assistance of an alternating voltage only above a DC voltage of 8 kV with voltage breakdown occurring above 9 kV in the layer 8 to be charged.

EXAMPLE 5

A photoconductive layer of 10 μm thickness of equal molecular parts of poly-N-vinylcarbazole and trinitrofluorenone, applied to a conductive support of aluminized polyester film, was charged to a DC voltage of −800 V.

For this the photoconductive layer 8 was moved past at a distance of 5 mm below the DC voltage electrode 5 of the electrode arrangement according to FIG. 6 at a speed of 30 cm/s. Further data were:

AC voltage electrode 7 was a 1.8 mm thick copper wire;

DC voltage electrode 5 was a 100 μm thick steel wire;

Length of DC voltage electrode 5 was 300 mm;

Insulating body 23 was comprised of a glass tube of 14 mm diameter;

Shielding case 24 was 3 mm thick plastic; and

Gap width was 3 mm.

A DC voltage $U_{DC}=-800$ V was applied to the DC voltage electrode 5.

Depending on the geometric configuration of the electrode arrangement, the DC voltage generator 2 is tuned via the voltage regulator 17 and frequency control 18. Within the $U_{AC}$ control range of from 1 to 5.7 $kV_{RMS}$ for AC voltage, the voltage on the photoconductive layer 8 was first smaller than the pre-existing DC voltage but later increased with an increase in AC voltage up to the predetermined nominal value. With an AC voltage $U_{AC}=5.7$ $kV_{RMS}$, the voltage amplitude was relatively independent of the frequency and corresponded to the predetermined value of DC voltage. The greatest charging current with this AC voltage was measured at 34 kHz at a half-width of approximately ±4 kHz.

Within the $U_{AC}$ control range of 5.7 to 10 $kV_{RMS}$, the photoconductive layer 8 was charged to 31 800 V, more or less depending on the frequency setting.

Overall, the photoconductive layer was charged to −800 V under the specified conditions with good reproducibility and without breakdowns in the photoconductive layer. After the charging, the layer was exposed image-wise, developed with toner and the toner image transferred to paper.

EXAMPLE 6

A photoconductive thermoplastic recording layer 8 on a 50 μm thick polyester base resting on a glass plate with a transparent conductive layer was charged to +5200 V.

The recording layer 8 consisted of an approximately 1 μm thick part-layer of bromopyrene resin to which was added 1/5 part by weight of dicyanomethylenetrinitrofluorenone and ½ part by weight of a copolymer of vinyl chloride and vinyl acetate. On top of this there was a second, approximately 0.5 μm thick, part-layer of the glycerol ester of hydrogenated colophony.

The electrode arrangement was adjusted as in Example 5, with the only difference that the DC voltage at the DC voltage electrode 5 was +5200 V. The charging took place in a reproducible manner without breakdowns occurring in the recording layer.

After the charging, the interference-producing light of a He/Ne laser was used to irradiate the recording layer with an intensity pattern of 820 lines/mm, after which the recording layer was heated to 70° C. over a period of 1/10 s, producing a relief grid which diffracted the irradiating laser light.

EXAMPLE 7

On a polyester film of 50 μm thickness in an ionization chamber, a charge image corresponding to the irradiating X-ray intensity pattern was generated which was made visible with toner. In this process, density fluctuations in the precipitated toner occurred also at places of equal intensity. These fluctuations were prevented by a subsequent neutralizing charging of the polyester film with the following electrode arrangement:

AC voltage electrode 7 was a 1.8 mm thick copper wire;

DC voltage electrode 5 comprised a tungsten wire of 50 μm diameter; and

Insulating body 23 was a glass tube of 9 mm outside diameter.

At a distance of 5 mm to the polyester layer, the DC voltage electrode 5 was arranged; and at a distance of 10 mm to the outside diameter of the insulating body 23, the AC voltage electrode 7 was arranged. The DC voltage electrode 5 was placed at ground potential and the AC voltage electrode 7 was first operated at 3 $kV_{RMS}$. The polyester layer was moved past several times under the DC voltage electrode 5. During this, the AC voltage was increased in steps up to 4.5 $kV_{RMS}$. For further neutralization of the residual charge on the polyester film, the frequency of the AC voltage was changed for the purpose of balancing in steps in the range between 30 and 40 kHz. The starting point was 35 kHz and an optimum degree of charge neutralization was achieved at 32 kHz.

With these adjustments, the polyester film could be neutralized to such an extent that on its surface only a residual voltage of 1.5 V was measured with a solid state electrostatic voltage meter.

EXAMPLE 8

A 20 μm thick thermoplastic recording layer 8 comprised of glycol ester of hydrogenated colophony was placed on a polyester base of 50 μm thickness and was charged to +5 kV in a raster-shaped pattern.

The recording medium was moved past on the grounded base at a distance of 5 mm from the DC voltage electrode 5 underneath an electrode arrangement according to FIG. 6 at a speed of 10 cm/s. The remaining data were:

AC voltage electrode 7 was a 1.8 mm thick copper wire;

DC voltage electrode 5 was a 50 μm thick tungsten wire;

Insulating body 23 comprised a glass tube of 9 mm diameter;

Gap width was 1 mm;

AC voltage applied was 5 $kV_{RMS}$/30 kHz; and

Distance between the electrodes 5 and 7 was 6.5 mm.

For modulation of the charging voltage of the recording layer, the AC voltage was interrupted periodically with the switching element 10 according to FIG. 1 by means of a frequency generator connected to the terminal 13. The switching element 10, consisting of an integrated semiconductor switch, made practically delayless control of the AC voltage possible.

The pulse duration and the dead time during which the switch was being opened or closed, respectively, was 10 milliseconds in each case. A DC voltage of +5 kV was applied to the DC voltage electrode 5.

After the raster-shaped charging the recording medium was heated with hot air at approximately 50° C. during which a relief grid of 5 lines/mm was produced.

EXAMPLE 9

Example 8 was repeated, the raster-shaped charging being overlaid by a further charging pattern. For this the recording medium, charged in a raster-shaped pattern, was introduced together with the conductive base into an ionization chamber. The conductive base consisted of a 5×5 cm glass plate with a conductive transparent layer with reinforced electrodes at opposite sides. The plate electrodes were connected to lines leading outside the chamber. Above this plate there was a second transparent electrode at a distance of 1 cm. The housing of the ionization chamber consisted of 15 mm thick Plexiglass. The chamber was evacuated and filled with xenon under slightly positive pressure. The electrode with the recording layer resting on it was placed at ground potential and a voltage of −8 kV was applied to the upper electrode. Before the exposure with 80 kV X-rays, a flat lead wedge was introduced into the path of the beam. As the lower electrode was heated by a voltage surge of 70 V for a period of 0.1 s, a relief picture was generated on the thermoplastic recording layer which was read out with a system of Schlieren optics. In the areas where the X-rays were weakened by the lead wedge, its contours could be recognized, overlaid by a line-shaped raster structure. The intensity of the raster increased with the thickness of the lead wedge during the X-ray exposure, making possible a corresponding halftone reproduction of the lead wedge.

EXAMPLE 10

A 300 μm thick selenium layer on a 2 mm thick aluminum plate was coated with a 20 μm thick thermoplastic recording layer consisting of the glycol ester of hydrogenated colophony. With the adjustments of Example 8, a screen-shaped charging occurred to +1800 V, the recording layer being irradiated with X-rays of 80 kV through a flat lead wedge and heated with hot air. This produced a relief picture of the lead wedge which was read out with a system of Schlieren reflection optics. At the places protected from the X-ray exposure by the lead wedge, the relief picture had a line-shaped raster. The intensity of the raster increased with the thickness of the lead wedge during the X-ray exposure, producing a halftone image of the lead wedge.

EXAMPLE 11

A charge pattern with correspondingly variable input data was applied to an insulating recording layer 8.

The recording layer 8 located 5 mm below the electrode arrangement according to FIG. 6 was moved past at a speed of 45 cm/s. The remaining data were:

AC voltage electrode 7 was a 1.8 mm thick copper wire;

DC voltage electrode 5 was a 50 μm thick tungsten wire;

Insulating body 23 comprised a glass tube of 9 mm diameter;

AC voltage was 5 $kV_{RMS}$/30 kHz; and

DC voltage was −300 V.

This electrode arrangement with a gap width of 1 mm was installed in the circuit according to FIG. 1, the modulation taking place via the terminal 15 of the switching element 12 in the ground line of the counter-electrode 9.

The counter-electrode 9 consisted of a plastic plate with a copper coating, such as is used for the manufacture of printed circuit boards. Into the copper layer connected as counter-electrode 9 raster lines were etched photomechanically, as can be seen from FIG. 9. During the recording, a voltage drop of −300 V to 0 V was generated at the counter-electrode 9.

During the development with liquid toner, increasingly only toner was precipitated on the recording layer 8 along the path of movement. The toner image transferred to paper clearly showed the increase in blackening along the path of movement and the raster lines of the counter-electrode 9 were reproduced clearly. There were no breakdowns in the recording layer 8.

EXAMPLE 12

A charge pattern according to variable input data was applied to an insulating thermo-plastic recording layer 8 with the formation of relief structures.

The recording layer 8 consisted of a 20 μm thick layer of the glycol ester of hydro-genated colophony on a 50 μm thick polyester film and was charged in accordance with the adjustments of Example 11, the preset DC voltage $U_{DC}$ being −5 kV. The AC voltage of 5 $kV_{RMS}$ at 30 kHz was modulated periodically with 3 kHz from a frequency generator via the switching element 10 and the terminal 13.

During the developing of the recording layer 8 with hot air at approximately 50° C., a relief picture of the counter-electrode 9 was obtained. The depth of the relief increased along the path of movement. In the projection with a system of Schlieren optics, the counter-electrode 9 was represented with increasing darkness in the direction of movement.

EXAMPLE 13

A charging pattern with correspondingly variable input data was applied to the insulating recording layer 8 of a dielectric paper with a conductive paper base 29. The dielectric paper was moved past at a distance of approximately 0.5 mm underneath an electrode arrangement according to FIG. 10 at a speed of 25 cm/s. The remaining data were:

AC voltage electrode 7 was a 1.8 mm thick copper wire;

DC voltage electrode 5 was comprised of individual tungsten wires of 150 μm thickness, arranged mutually insulated at distances of approximately 300 μm; and AC voltage was 5 $kV_{RMS}$/30 kHz.

The gap width of the shielding case 24 was 1 mm. The electrode arrangement was installed with the circuitry according to FIG. 11. The DC voltage $U_{DC}$ was applied via the switching elements 11*a*, 11*b*, 11*c*, etc., in parallel with each other, to the associated single electrodes 5*a*, 5*b*, 5*c*, etc. The individual control signals for controlling the single electrodes 5*a*, 5*b*, 5*c*, etc., were applied to the terminals 14*a*, 14*b*, 14*c*, etc., of the switching elements 11*a*, 11*b*, 11*c*, etc.

Initially, all wire ends were connected to each other conductively via the terminals 31*a*, 31*b*, 31*c*, etc., and, similar to Example 11, a DC voltage $U_{DC}$, varying continuously from −500 V to 0 V, was applied to the wire ends of the single electrodes via a potentiometer tap 27 (FIG. 9). During the development with liquid toner, increasingly less toner was precipitated on the dielectric paper in the direction of movement. During this process, no writing traces of the single electrodes 5*a*, 5*b*, 5*c*, etc., were produced. There were no breakdowns and the halftone reproduction was satisfactory throughout. The line traces of adjacent single electrodes adjoined free of separating lines so that the transition from one single electrode to the adjacent single electrode could not be recognized visually.

In this example, a DC voltage $U_{DC}$ −500 V was applied also only to a single electrode, for example, the electrode 5*a*, or to a group of single electrodes, while the remaining single electrodes were at ground potential. The applied DC voltage was then frequently interrupted for periods of different lengths during the recording. The picture developed with liquid toner showed writing traces up to a width from approximately 0.3 mm down, in the direction of movement and transversely to this. There were no breakdowns.

With this invention, the disadvantages of the coronas according to the state of the art are overcome, which consist in that on application of a high direct voltage to wire coronas or corona needle points the control of such coronas for achieving a predetermined charging voltage on the insulating layer is possible only in a limited way so that the coronas are operated in connection with additional electrodes in the form of control grids, the efficiency of the charging voltage, however, being low in relation to the charging current. Apart from the difficulty of controlling the charging voltage, the quality of charging, too, is often unsatisfactory because breakdowns occur or the charging fluctuates due to soiling of the corona wires or consumption of the corona needle points. With increasing constructional length of the coronas, such defects increase. Since high voltages of several thousand volts must be applied to the coronas in order to achieve ionization, it is necessary to take corresponding safety precautions.

The present invention provides the advantages that, in a high-frequency alternating electric field, ions are produced which form a reservoir of charge carriers, as it were, from which the charging current is transported to the recording layer with the aid of the constant electrostatic field. In this arrangement it is possible to surround the alternating voltage electrode with an insulating body forming a dielectric which increases the field strength in the area of the direct voltage electrode and simultaneously protects the electrode from contamination. Since it is possible to modulate the direct voltage and alternating voltage supply or the potential of the counter-electrode of the constant field, it is possible to charge up the dielectric layer in a modulated or locally limited manner.

The method and the device can be applied with advantage in the production of electrophotographic copies with the aid of an insulating photoconductive layer as a recording base which is charged, exposed image-wise and developed with toner in order to make the charge image produced on the photoconductive layer into a visible image. The invention can also be used with advantage in the electro-photographic production of relief pictures in which the photoconductive and simultaneously thermoplastic recording medium is first charged, then exposed image-wise and then heated until a relief picture is formed. It is also possible to produce toner or relief pictures by charging a purely thermoplastic recording layer image-wise.

It is to be understood that the forms of the invention hereindescribed are to be taken as preferred embodiments. Various changes may be made in the shape, size and arrangement of the parts, as will be obvious to one of ordinary skill in the art in view of the specification. However, the scope of the invention is limited only by the scope of the claims appended hereto.

What is claimed is:

1. A method for electrostatically charging a dielectric layer to a predetermined potential by an AC electric field and a DC electric field, said method comprising steps of:

generating charge carriers around a common electrode by adjusting the AC electric field generated by an AC discharge electrode between said common electrode and said AC discharge electrode to ionize the atmosphere to its saturation value, said charge carriers being generated around said common electrode at a distance from the dielectric layer;

directing said charge carriers to said dielectric layer by a DC electric field generated exclusively by a DC discharge electrode, said DC discharge electrode being said common electrode and being disposed between said AC discharge electrode and said dielectric layer and thereby the charge carriers form a charging current to charge the surface of said dielectric layer, whereby said AC and DC electric fields act on said common electrode without influencing each other; and modulating at least one of said electric fields during the charging of the dielectric layer.

2. The method according to claim 1, wherein the dielectric layer comprises a photoconductive recording base.

3. The method according to claim 1, wherein the dielectric layer comprises a thermoplastic recording base.

4. The method according to claim 1, including prior to the generating step, the steps of:

mounting said dielectric layer on a counter-electrode to said DC discharge electrode, the DC electric field being generated between the counter-electrode and the DC discharge electrode, which are connected with terminals of a DC voltage source; and wherein the step of modulating comprises modulating the potential of said counter-electrode during the charging of the dielectric layer.

5. The method according to claim 1, wherein the generating step includes the step of adjusting the frequency of the AC electric field to within the range of 5 to 100 kHz.

6. The method according to claims 2 or 3, wherein the modulating step includes the step of voltage modulating the AC electric field.

7. The method according to claim 6, wherein said voltage-modulating step includes modulating said AC electric field with periodic rectangular voltage pulses.

8. The method according to claim 6, wherein said voltage-modulating step includes modulating said AC electric field with an information-dependent voltage.

9. The method according to claims 2 or 3, wherein said modulating step includes the step of voltage modulating said DC electric field.

10. The method according to claim 9, wherein said voltage modulating step periodically modulates said DC electric field.

11. The method according to claim 9, wherein said voltage modulating step includes the step of voltage modulating said DC electric field with an information-dependent voltage.

12. The method according to claim 9, wherein said step of voltage modulating takes place in discrete spatial sections transversely with respect to said dielectric layer.

13. The method according to claims 2 or 3, wherein said modulating step includes the step of modulating said AC electric field and the step of modulating said DC electric field.

14. The method according to claim 1, wherein after said directing step, said method includes the step of applying a stream of ions to the charged dielectric layer in order to modify the electrostatic charge thereon.

15. The method according to claim 1, wherein after said directing step, said method includes the step of applying electromagnetic radiation to the charged dielectric layer in order to modify the electrostatic charge thereon.

16. The method according to claim 1, wherein prior to said generating step, said method includes the step of erasing residual charges in the dielectric layer by charging said dielectric layer to zero potential.

17. The method according to claim 1, wherein prior to said generating step, said method includes the step of providing an atmosphere of blanketing gas in the region of the AC and DC discharge electrodes.

* * * * *